US008443937B2

(12) United States Patent
Mordecai et al.

(10) Patent No.: US 8,443,937 B2
(45) **Date of Patent: *May 21, 2013**

(54) FLOATING HARNESS WITH CONTINUOUS LOOP

(75) Inventors: Mark Mordecai, Hampton, NH (US); Julie Snedeker, Northwood, NH (US); John R. Yates, Redding, CA (US)

(73) Assignee: Globe Holding Company LLC, Pittsfield, NH (US)

( * ) Notice: Subject to any disclaimer, the term of this patent is extended or adjusted under 35 U.S.C. 154(b) by 471 days.

This patent is subject to a terminal disclaimer.

(21) Appl. No.: 12/325,423

(22) Filed: Dec. 1, 2008

(65) Prior Publication Data

US 2009/0078501 A1 Mar. 26, 2009

Related U.S. Application Data

(63) Continuation-in-part of application No. 11/677,209, filed on Feb. 21, 2007.

(60) Provisional application No. 60/775,230, filed on Feb. 21, 2006.

(51) Int. Cl.
*A62B 35/00* (2006.01)

(52) U.S. Cl.
USPC ..... 182/3

(58) Field of Classification Search
USPC ..... 182/3, 5, 6; 2/227; 119/792, 793, 119/857, 907
See application file for complete search history.

(56) References Cited

U.S. PATENT DOCUMENTS

| | | | | |
|---|---|---|---|---|
| 3,424,134 | A | 1/1969 | Rosenblum | |
| 3,973,643 | A | 8/1976 | Hutchinson | |
| 4,446,943 | A | 5/1984 | Murray | |
| 4,632,217 | A * | 12/1986 | Markwell et al. | 182/3 |
| 5,036,548 | A * | 8/1991 | Grilliot et al. | 2/81 |
| 5,136,724 | A * | 8/1992 | Grilliot et al. | 2/81 |
| 5,145,027 | A | 9/1992 | Petzl et al. | |
| 5,289,590 | A * | 3/1994 | Larson | 2/227 |
| 5,445,114 | A | 8/1995 | Walker | |

(Continued)

OTHER PUBLICATIONS

The American Heritage® Dictionary of the English Language, Fourth Edition copyright © 2000 by Houghton Mifflin Company. Updated in 2009. Published by Houghton Mifflin Company. All rights reserved. see definition of 'fixed' in Action.*

(Continued)

*Primary Examiner* — Alvin Chin Shue
*Assistant Examiner* — Daniel Cahn
(74) *Attorney, Agent, or Firm* — Finch & Maloney PLLC

(57) ABSTRACT

A safety harness and techniques for integrating the safety harness into apparel such as a firefighter's turnout suit. The safety harness may include a waist belt having a fastener (e.g., buckle) for adjustably securing the waist belt around a wearer's waist, first and second leg straps for encircling a wearer's legs, and a continuous support strap fixed to each of the first and second leg straps and slideably attached to the waist belt. The continuous support strap has a front middle portion for coupling to a coupling mechanism (e.g., carabiner, ladder hook, knot, clamp, weld, or a combination thereof) and having sufficient slack so as to not impede access to the waist belt fastener. Under no-load conditions, the front middle portion of the continuous strap may hang down below the waist belt fastener, or may be stowed to one side of the waist belt fastener.

24 Claims, 9 Drawing Sheets

U.S. PATENT DOCUMENTS

| | | | | |
|---|---|---|---|---|
| 5,615,750 | A | 4/1997 | Phillips | |
| 6,050,364 | A | 4/2000 | Popall et al. | |
| 6,125,792 | A * | 10/2000 | Gee | 119/770 |
| 6,244,379 | B1 * | 6/2001 | Larson | 182/6 |
| 6,308,335 | B1 * | 10/2001 | Colorado | 2/81 |
| 6,431,313 | B1 | 8/2002 | Petzl et al. | |
| 6,490,733 | B1 * | 12/2002 | Casaubon | 2/81 |
| 6,637,547 | B1 * | 10/2003 | Wydner | 182/3 |
| 6,892,395 | B2 | 5/2005 | Schweer | |
| 7,445,085 | B2 * | 11/2008 | Petzl et al. | 182/6 |
| 8,281,894 | B2 | 10/2012 | Mordecai et al. | |
| 2003/0146044 | A1 * | 8/2003 | Jordan | 182/3 |
| 2005/0067221 | A1 * | 3/2005 | Wolner et al. | 182/3 |
| 2007/0023231 | A1 * | 2/2007 | Gorman et al. | 182/3 |
| 2007/0272484 | A1 * | 11/2007 | Helms | 182/3 |
| 2007/0278036 | A1 * | 12/2007 | Barta et al. | 182/3 |
| 2008/0282442 | A1 * | 11/2008 | Bauvois | 2/79 |

OTHER PUBLICATIONS

The American Heritage® Dictionary of the English Language, Fourth Edition copyright © 2000 by Houghton Mifflin Company. Updated in 2009. Published by Houghton Mifflin Company. All rights reserved. see definition of circumference in Action.*

U.S. Appl. No. 11/615,262 specification as filed Dec. 22, 2006, 22 pages.

U.S. Appl. No. 11/615,262 drawings as filed Dec. 22, 2006, 16 pages.

Gemtor #541NYC—Class II Fire Service Harness, Aug. 2007, 1 page, http://www.gemtor.com/541NYC_flyer.pdf, downloaded Oct. 22, 2008.

Gemtor . . . when your life is on the line, 1 page, Gemtor, Inc., Matawan, NJ.

* cited by examiner

FLOATING HARNESS WITH CONTINUOUS LOOP

RELATED APPLICATIONS

This application is a continuation-in-part of U.S. application Ser. No. 11/677,209, titled "FLOATING HARNESS" and filed Feb. 21, 2007, which claims the benefit of U.S. Provisional Patent Application Ser. No. 60/775,230, filed Feb. 21, 2006. Each of these applications is herein incorporated by reference in its entirety.

BACKGROUND

1. Field of Invention

The invention relates to a safety harness, and in particular, to a floating safety harness that may be integrated into apparel such as a firefighter's turnout suit.

2. Discussion of Related Art

Firefighters and other emergency or first responders traditionally wear outer clothing known in the art as a turnout suit. The turnout suit protects the firefighter against flame, heat, and water. Typically, a turnout suit includes a coat and trousers that each have an inner liner and an outer layer. The shell or outer layer is constructed from materials that can be resistant to abrasion, flame, heat, and water. The inner liner, typically releasably secured to the outer layer to permit the liner to be removed for cleaning and repair purposes, is preferably constructed from thermal and/or wicking materials. In addition to the turnout suit, firefighters may wear other equipment such as boots, helmet, gloves, and a self-contained breathing apparatus (SCBA). This ensemble can be heavy and bulky. Thus, there is understandably a resistance to add any further equipment to what is already in use Nonetheless, the nature of firefighting and emergency response requires that responders carry more equipment in certain instances. Traditionally, firefighters have carried ropes and an emergency climbing harness to help them escape safely from upper floors of burning buildings. The ropes and climbing harness are frequently referred to as personal fall protection equipment (PFE). The PFE, when worn, provides a reliable fastening point on the user's body that enables both coupling to an anchor point and repelling therefrom, thus facilitating a safe escape. Even when the PFE is readily available, in an emergency situation it can be difficult and time consuming to don it.

SUMMARY OF INVENTION

One embodiment of the present invention provides a floating harness. The harness includes a waist belt having a fastener for adjustably securing the waist belt around a wearer's waist, a first leg strap for encircling a wearer's first leg, and a second leg strap for encircling the wearer's second leg. The harness further includes a continuous support strap fixed to each of the first and second leg straps, and slideably attached to the waist belt. The continuous support strap includes a front middle portion for attaching to a coupling mechanism, and has sufficient slack so as to not impede access to the waist belt fastener. The waist belt fastener can be, for example, a buckle that locks when the harness is under a load. In one particular case, the first and second leg straps are both of fixed circumference. In another particular case, the continuous support strap is configured with support loops through which the waist belt is slideably attached. In another particular case, the first leg strap, second leg strap, and continuous support strap are formed from a single contiguous strap that is overlapped and selectively stitched so as to provide support loops in the continuous support strap through which the waist belt is slideably attached. In another particular case, the first leg strap, second leg strap, and continuous support strap are formed from two straps selectively overlapped and stitched so as to provide support loops in the continuous support strap through which the waist belt is slideably attached. In another particular case, the first leg strap, second leg strap, and continuous support strap are configured for integration into trousers that have openings which allow at least the front middle portion of the continuous support strap to be accessed outside the trousers. In another particular case, when the harness is donned by a wearer, the front middle portion of the continuous strap can be stowed off to one side of the waist belt fastener and still not impede access to the waist belt fastener. For instance, a carabiner attached to the front middle portion can be temporarily secured at waist level of the wearer using a cloth loop or other such stowing device on the trousers, thereby securely stowing both the carabiner and front middle portion off to one side of the waist belt fastener. In another particular case, the front middle portion of the continuous support strap includes a keeper loop for maintaining a central position of the coupling mechanism. The coupling mechanism may include, for example, a carabiner, ladder hook, knot, clamp, weld, or a combination thereof. In another particular case, the front middle portion of the continuous support strap includes a slidably attached D-ring. This D-ring can be, for example, securely coupled to a cable of repelling gear accessible to the wearer (e.g., in a pocket of the trousers).

Another embodiment of the present invention provides a firefighter's ensemble, which includes trousers and a floating harness having features as previously described. As previously explained, the first leg strap, second leg strap, and continuous support strap can be integrated into the trousers, wherein the trousers have openings that allow at least the front middle portion of the continuous support strap to be accessed outside the trousers. Likewise, the waist belt may be integrated into the trousers, wherein the trousers have openings which allow at least the waist belt fastener to be accessed outside the trousers. In some cases, the openings in the trousers that allow the front middle portion of the continuous support strap to be accessed outside the trousers are the same as the openings that allow the waist belt fastener to be accessed outside the trousers. In other cases, the waist belt may be coupled to outside of the trousers, wherein the trousers have openings which allow the integrated continuous support strap to be slideably attached to the external waist belt. The front middle portion of the continuous support strap may include, for example, a keeper loop for maintaining a central position of the coupling mechanism, and/or a slidably attached D-ring.

BRIEF DESCRIPTION OF DRAWINGS

Many features of the invention will be more readily understood by reference to the following detailed description, taken with reference to the accompanying drawings representing different embodiments, in which.

DETAILED DESCRIPTION

Figure 1A:
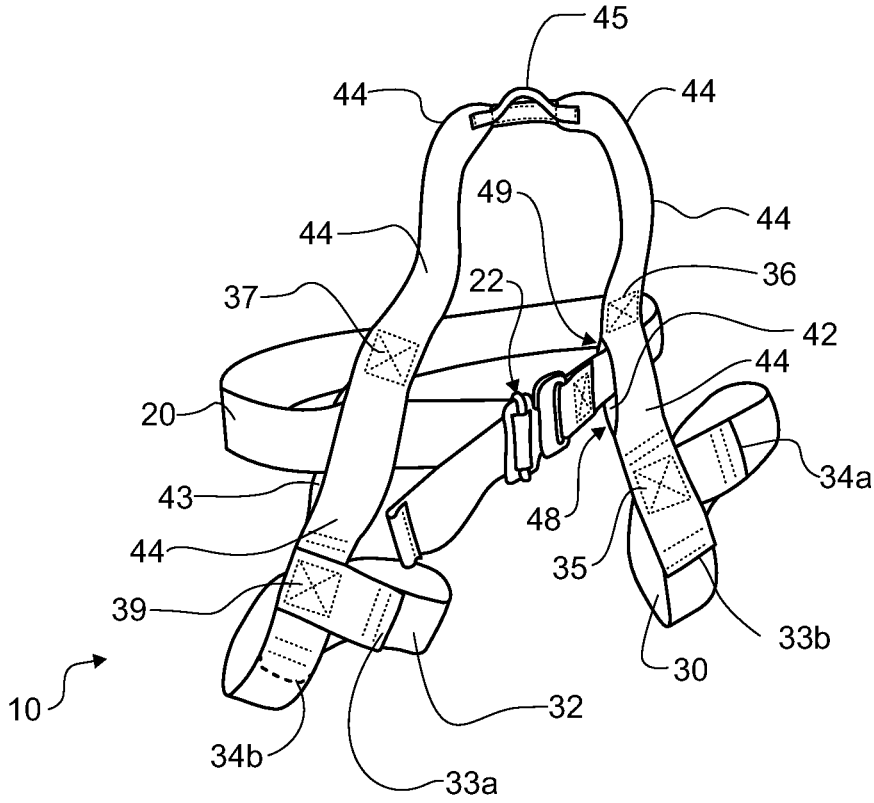
FIGS. 1A and 1B provide a perspective view of a floating harness configured in accordance with an embodiment of the present invention.

A number of different harness types are available to firefighters. For example, U.S. Pat. No. 6,244,379 discloses an automatically adjustable safety harness that may be incorporated into firefighter's trousers. The safety harness includes numerous straps used to adjust the harness. Specifically, it includes position straps that attach the leg loops to the rear of the waist belt to minimize jamming of the wearer's groin region during use. This harness includes leg loops that contract and tighten around the wearer's leg during use. To incorporate the harness into turnout gear, the harness is sewn into a lining and the lining is then fastened to the trousers via hook and loop fasteners. One longstanding drawback of this harness may be that because the harness is sewn into the lining and then fastened to the turnout gear, the wearer cannot easily adjust the harness to fit. Furthermore, the wearer may not be able to readily access the harness to unravel the numerous straps that may become twisted or entangled during wear or use.

Numerous recreational climbing harnesses also exist, but these harnesses are not designed for use in conjunction with protective trousers and may be too uncomfortable to be worn when climbing and/or descending. Therefore, there exists the need for a more comfortable safety harness that can be integrated into turnout gear while maintaining a high degree of safety for the wearer.

In one aspect of the present disclosure, a harness is provided that may be used in conjunction with apparel, such as firefighter's turnout gear. The harness may be a floating harness that allows different straps of the harness to move in relation to each other. In particular, a "floating harness" as used herein describes a safety harness in which one or more support straps are coupled to a waist belt but can move in relation to the waist belt. For instance, the support strap or straps may be capable of sliding vertically without significantly altering the positioning of the waist belt to which they are coupled. Such a harness can be, for example, simple to use, self-adjusting, non-constricting, and generally provide a greater level of comfort to the wearer. The harness may be worn inside or outside of firefighter apparel, or may be integrated into firefighter apparel. In some such cases, the harness may be fully or partially integrated with firefighter's trousers.

Thus, the harness and harness systems described herein include a design that can provide ease of use and maintenance, as well as comfort in a system that provides, for example, a class II level of protection. As previously noted, the harness may include a waist belt to which one, two, or more support straps are linked. The support strap or straps in turn can be attached to leg straps that encircle the wearer's thighs. In one particular embodiment, the support strap is a continuous strap running from one leg strap to the other leg strap. The continuous strap may comprise a single contiguous strap that is overlapped on itself and selectively stitched, or multiple straps that are selectively overlapped on one another and stitched together. The continuous support strap may include extra length or slack, so that when it is in the relaxed position (no load applied), it can be stowed, for instance, in front of the wearer (e.g., off to one side of the wearer's buckle) via a keeper loop formed centrally on the continuous strap. The slack allows the continuous support strap to be stowed without impeding the wearer's access to the waist belt buckle. In addition, the continuous support strap may link to the waist belt, for instance, via loops or openings provided in the support strap at locations offset from either side of the centrally located keeper loop. The waist belt may pass through these loops/openings but is not fixed to them. In this manner, the continuous support strap can move in relation to the waist belt while remaining attached or linked.

For instance, in a relaxed position with no load applied to the harness, the continuous support strap may sink to a lower position with an upper edge of each support strap loop/opening in contact with the waist belt. In such a position the leg straps may ride loosely on a lower portion of the wearer's thighs providing for increased comfort. When a load is applied to the harness, such as when the wearer is being lowered from a structure (or raised up to a structure), each support strap loop/opening may slide upwardly in relation to the waist belt until a lower edge of each support strap loop/opening is retained by a lower edge of the waist belt. In this case, the weight of the wearer is supported by the leg straps through the continuous support strap to a rope or cable that is securely attached, for example, via a coupling mechanism such as a ladder hook, carabiner, knot, clamp, or other suitable mechanism securely coupled onto the continuous support strap at the centrally located keeper loop position. Some of the weight may also be born by the waist belt. In addition, or alternatively to, the waist belt may keep the continuous support strap close to the wearer's body and to assure that the wearer's center of gravity is below the point of attachment. A point of attachment that is too low may cause instability that would allow the wearer to be turned upside down while being lowered/raised. In this sense, the waist belt and trousers can be used with the harness to help keep the point of attachment close to the wearer's body, and also help to maintain a stable position while lowering/raising/swinging/hanging/etc.

FIGS. 1A-8 illustrate embodiments of a floating harness 10 that can be integrated into firefighter's trousers 60. Although these embodiments are described specifically in the context of a firefighter's trousers, the present invention is not intended to be limited to use with this type of apparel. Rather, and as will be apparent in light of this disclosure, the present invention may have application in other vocations and avocations such as emergency response, military, and recreational climbing.

Figure 1B:
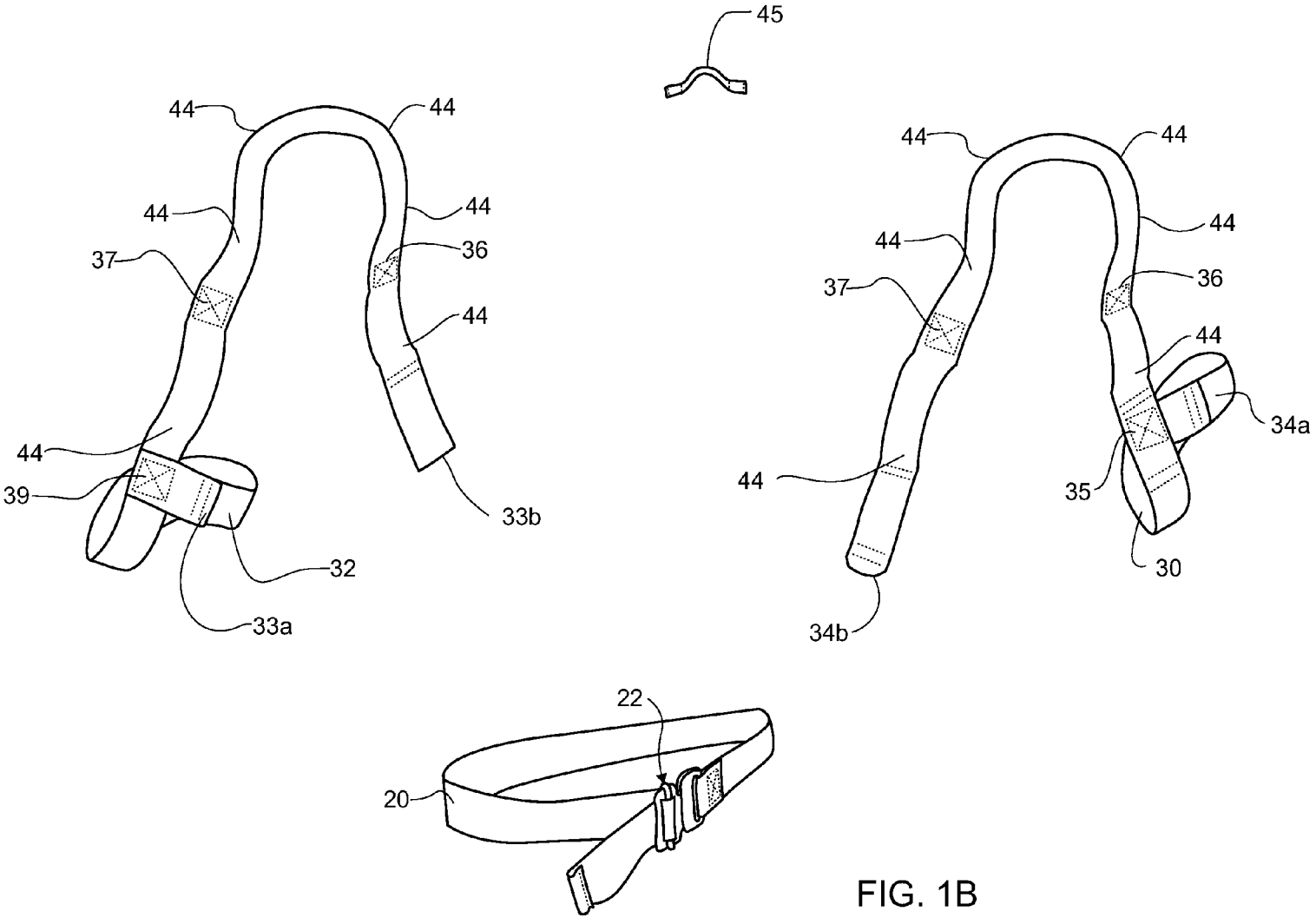

As illustrated in FIGS. 1A and 1B, the floating harness 10 may include a waist belt 20, leg straps 30 and 32, and a continuous support strap 44 that can be slideably attached to the waist belt 20. Continuous support strap 44 may be fixed to leg straps 30 and 32, respectively. Two straps that are "fixed" to each other are connected so that they cannot move independently at the fixed point. For example, two straps stitched to each other are fixed while a first strap passing through a loop or opening of a second strap may be connected but not fixed. Leg straps 30 and 32 may each be of fixed circumference for encircling a wearer's leg. In this particular case, a strap of fixed circumference does not change. Such straps of fixed circumference can be provided, for example, in varying sizes such as small, medium, and large to accommodate most users. In other embodiments, however, the length can be adjusted when the harness is not under load, typically with adjustable buckles, clips, clamps, or other such suitable mechanisms for adjusting straps and the like.

Figure 2:
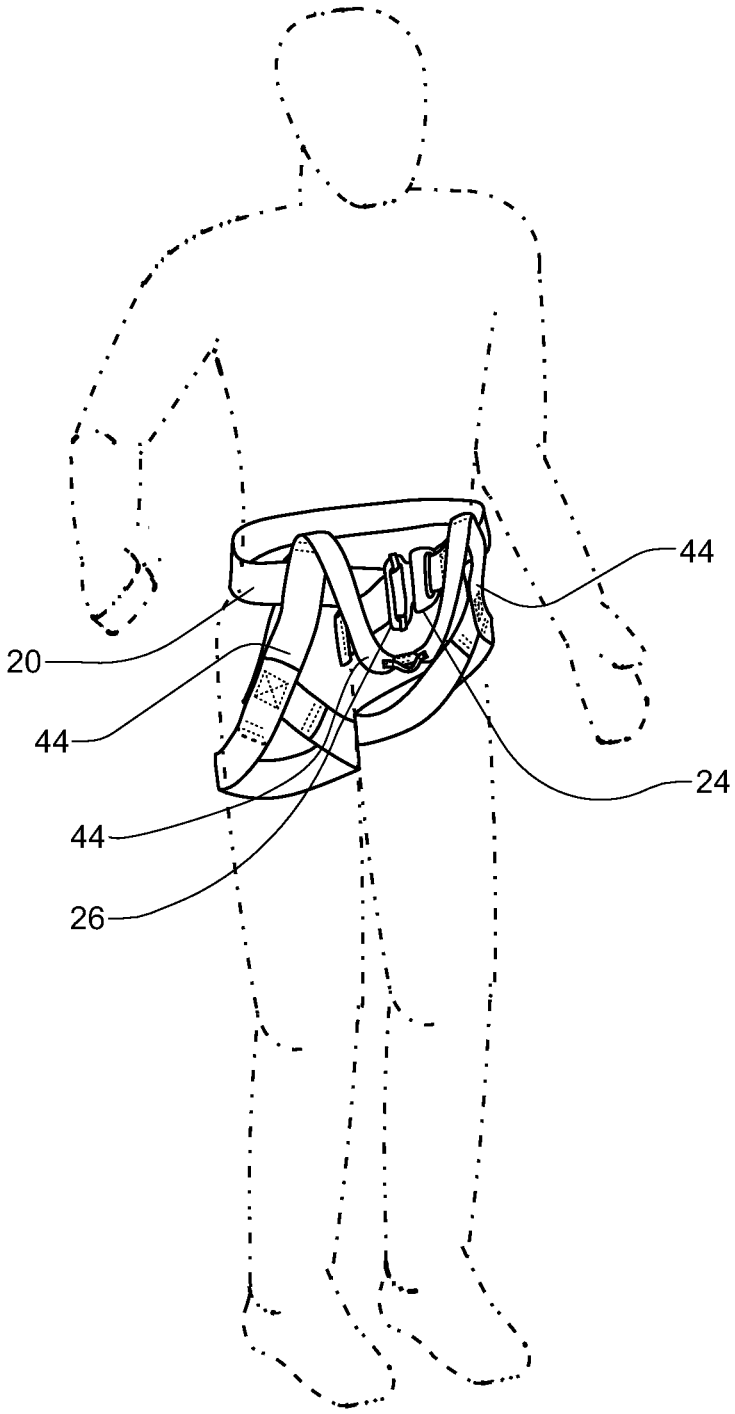
FIG. 2 shows the harness of FIG. 1A donned by a wearer under a no-load and not stowed condition, in accordance with an embodiment of the present invention.
Figure 3:
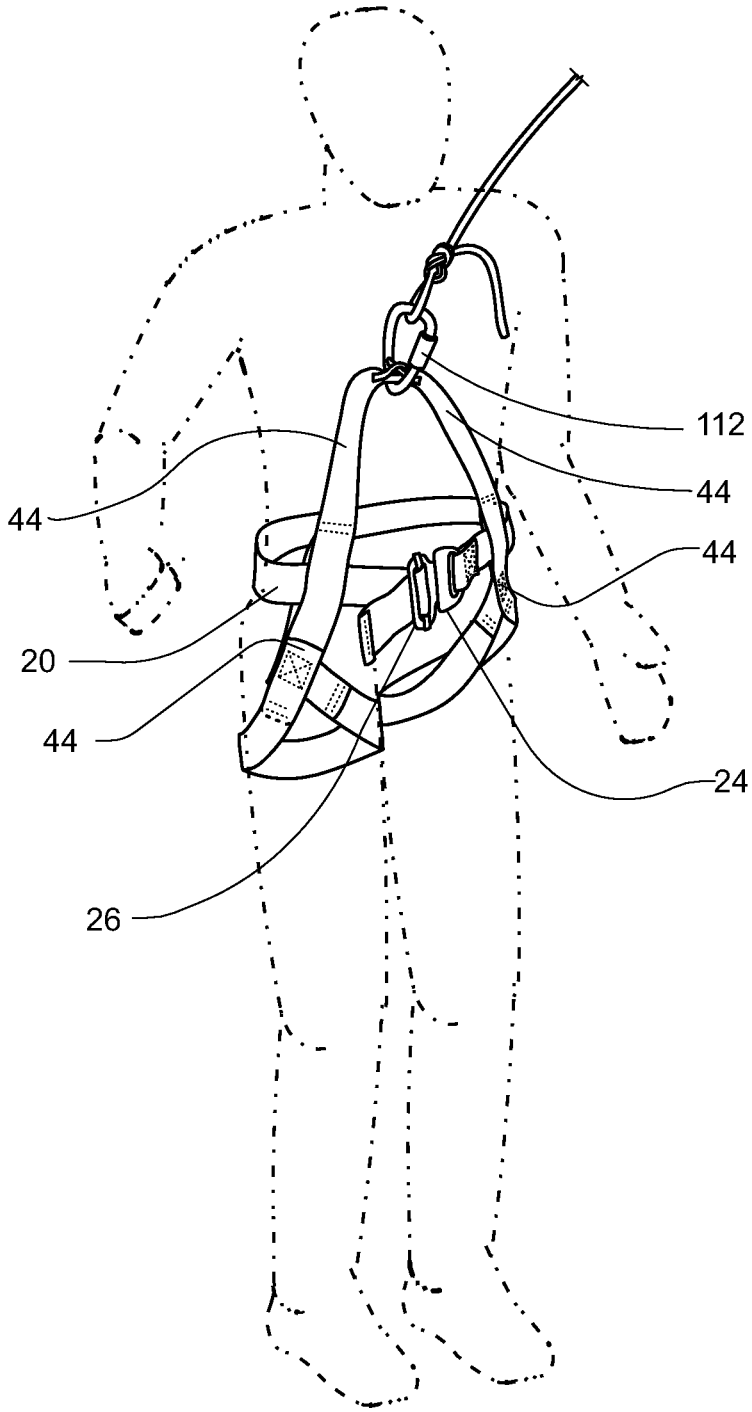
FIG. 3 shows the harness of FIG. 1A donned by a wearer under a load condition, in accordance with an embodiment of the present invention.
Figure 6:
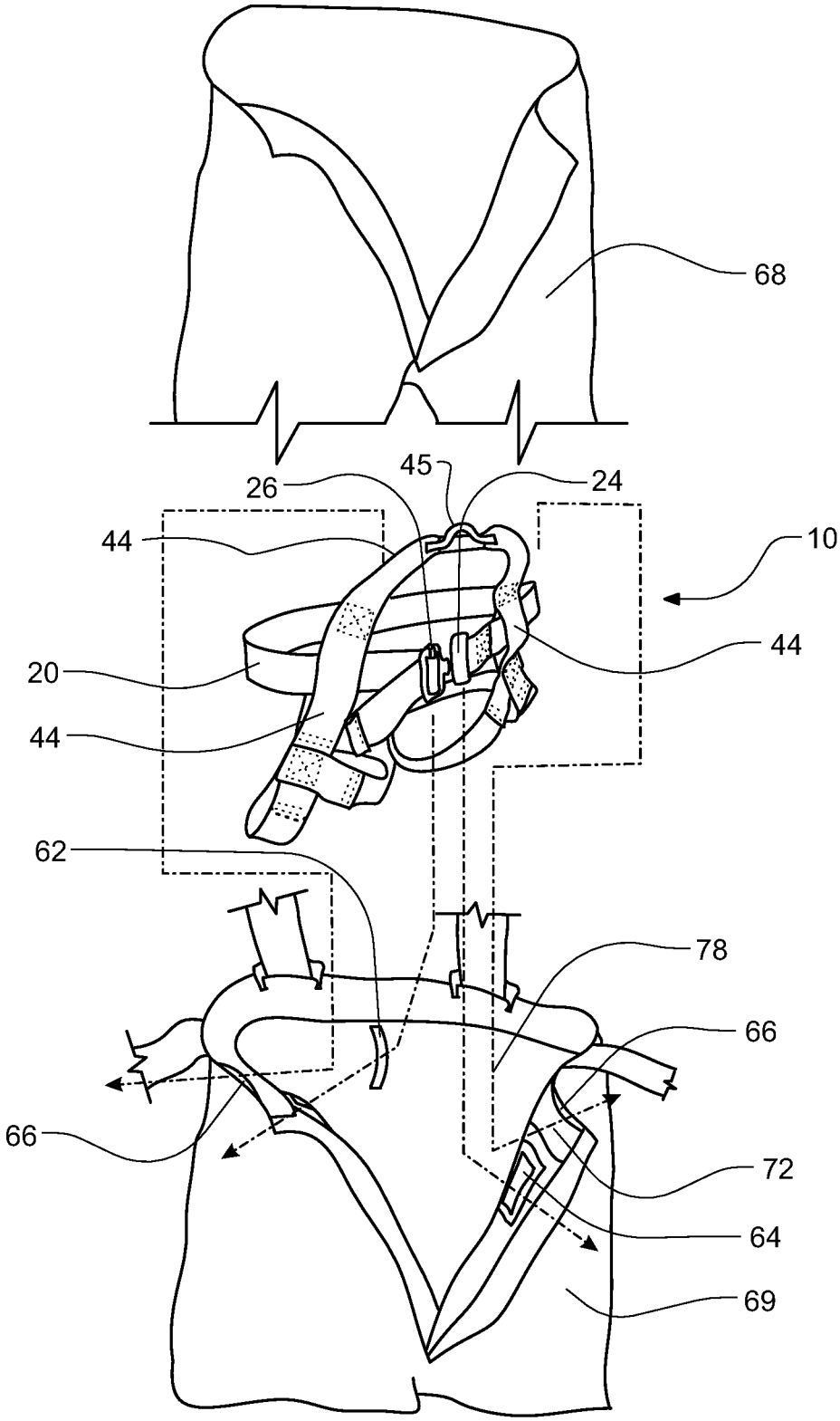
FIG. 6 provides a perspective view of how a floating harness, trouser liner, and trouser outer layer may be integrated together.
Figure 7:
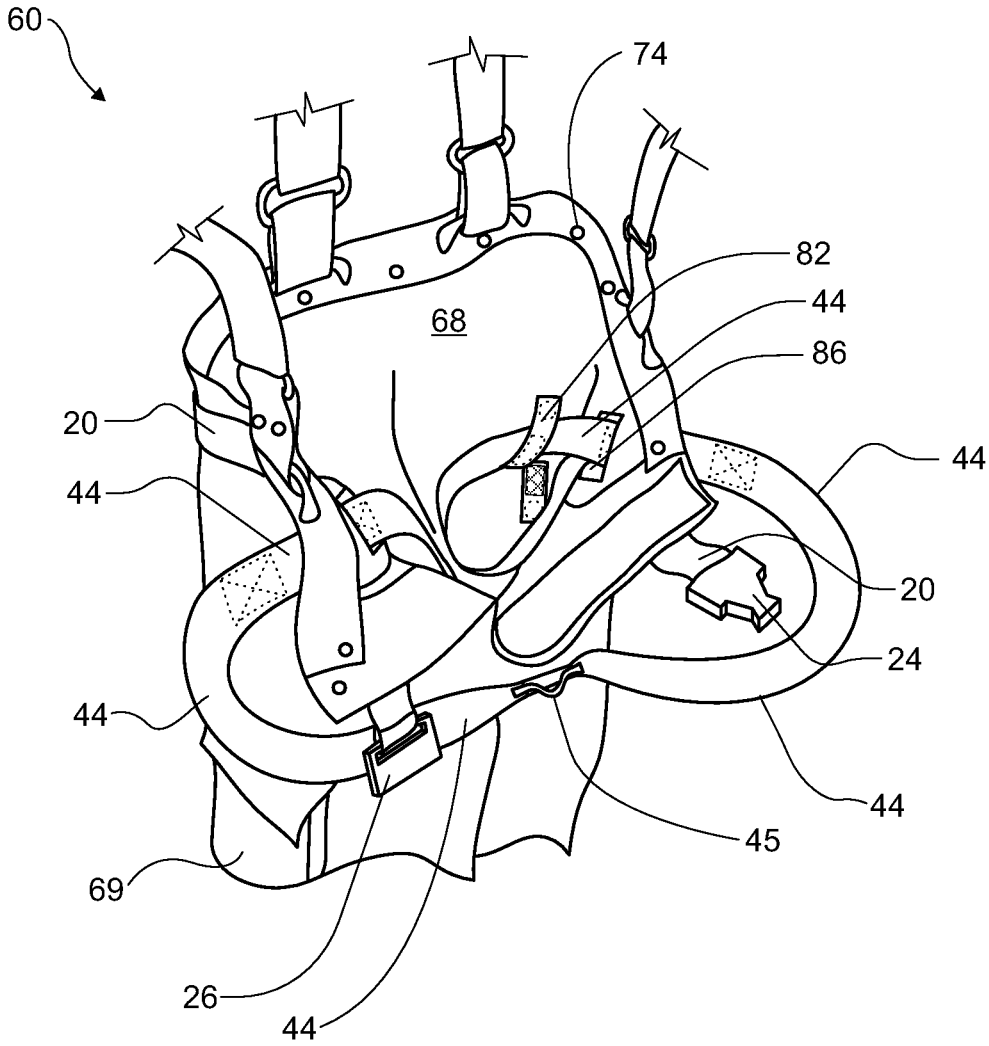
FIG. 7 provides a close up view of a floating harness integrated into firefighter's trousers, in accordance with an embodiment of the present invention.
Figure 8:
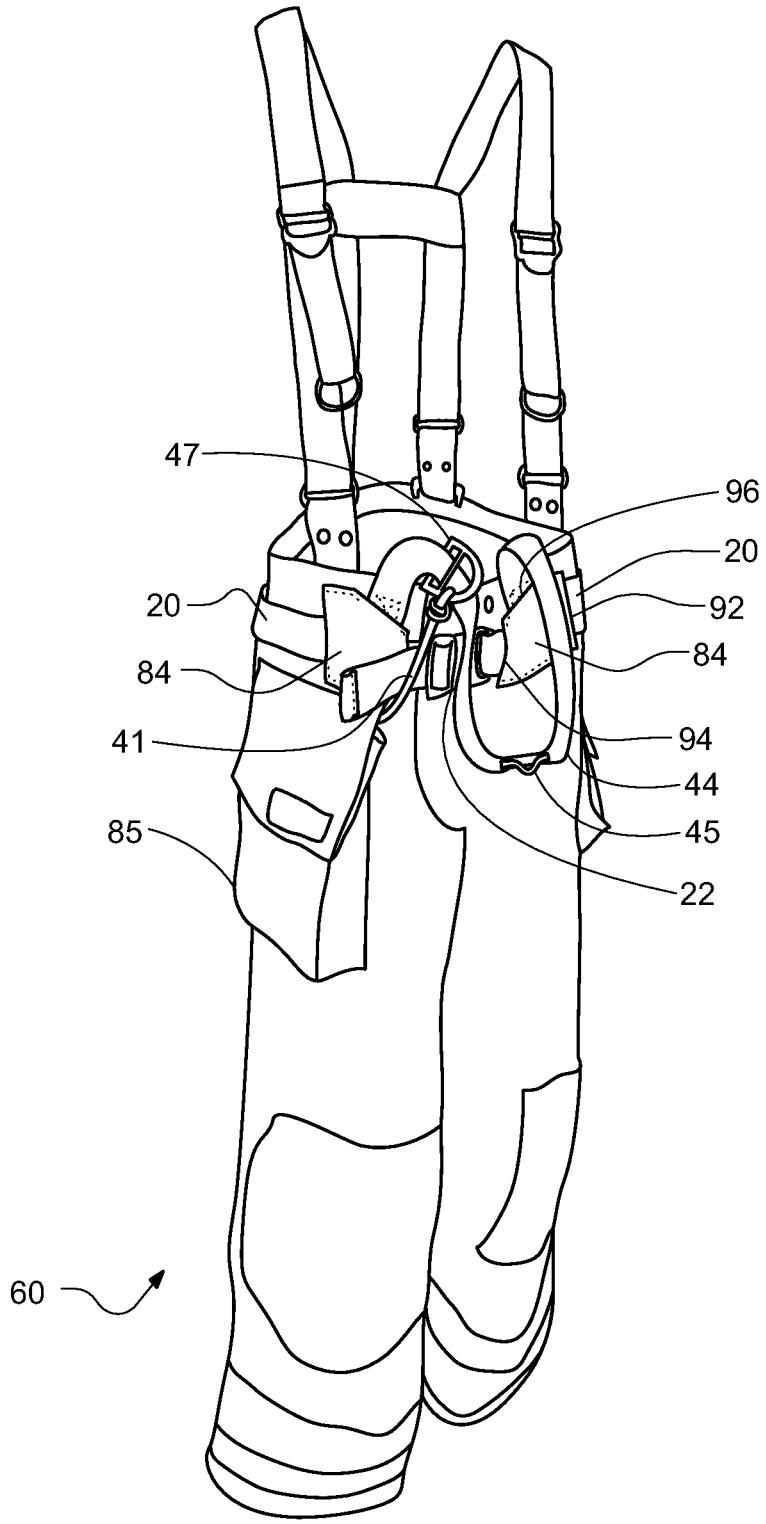
FIG. 8 provides a perspective view of another embodiment of a safety harness and trousers configured in accordance with an embodiment of the present invention.

Waist belt 20 of the floating harness 10 may be adjustably secured around the waist or trunk portion of the wearer (such as shown in FIGS. 2 and 3). A fastener 22 centered in front of the wearer's waist may be used to adjustably secure the waist belt 20. The fastener 22 may be, for example, a buckle 22 as shown in FIG. 1. As best shown in FIGS. 2-4 and 6-7, the buckle 22 may include buckle halves 24 and 26 that can be coupled with the ends of waist belt 20 to adjustably secure the waist belt 20 around the waist of the wearer. As shown in FIGS. 7-8, the waist belt 20 can be positioned outside of or otherwise external to the trousers 60 (e.g., using belt loops or guides), thereby providing the wearer access to the buckle 22. Alternatively, a portion of the waist belt 20 can be coupled to a surface inside or otherwise integrated into the trousers 60, as shown in FIG. 6. In such an integrated belt configuration, the end portions of waist belt 20 terminating in buckle halves 24 and 26 can be coupled externally of the trousers 60 through openings proximate either side of the buckle 22 area. Accordingly, when a firefighter wears turnout gear that includes a floating harness configured in accordance with an embodiment of the present invention, buckle 22 can be accessed externally of the trousers (regardless of whether the waist belt 20 is integrated or external). In some such embodiments, at least the external portions of the waist belt 20 and buckle 22 can comprise materials that meet the flame and heat resistance requirements of NFPA standards. Buckle 22 can be implemented with numerous suitable securing mechanisms. In one example embodiment, buckle 22 is implemented with a D-ring (e.g., for buckle halve 24) and a spring loaded hook (e.g., for buckle halve 26) that can be securely clipped onto the D-ring. In another example embodiment, the buckle 22 is implemented with a securing mechanism where the buckle 22 is biased in a closed position by, for example, a spring, so that the buckle 22 cannot open when harness 10 is under load.

The straps of harness 10 may be sized and constructed from a material capable of providing support and comfort to the wearer. In particular, the straps may be formed from materials that are sufficiently strong enough to support the wearer under the mechanical and environmental stresses of typically expected conditions, given a target application for the harness (e.g., firefighting, recreational climbing, etc). The straps may be joined or stitched to provide reinforcement to maintain the proper strength and/or meet applicable standards (with respect to quality, safety, established rating systems, etc). Waist belts, support straps and leg straps may be of the same or different materials. A variety of appropriate materials for the production of harness straps will be apparent in light of this disclosure. Some example strap materials include polyamide, polyester, polybenzimidazole (PBI), nylon, modacrylic, aramid fibers, and/or other natural and polymeric materials, and any combinations thereof. The straps may be joined by various suitable methods, such as by stitching (including double or otherwise reinforced or heavy duty stitching), clamping, pressed fittings, interweaving or otherwise integrally forming the straps, or combinations thereof. In one example embodiment, the waist belt 20 and other straps (e.g., 30, 32, and 44) making up the harness 10 are about 5 centimeters wide. It has been found that harnesses made from wider straps (e.g., 5 cm or greater) are less likely to become entangled during storage or donning. Leg straps having such widths can also aid in comfortably distributing the weight of the wearer when a load is applied. An optional liner or liners can also help to distribute the force and to prevent the leg straps from riding up into the wearer's groin area. As will be appreciated, the present invention is not intended to be limited to a particular strap material, strap dimensions, or stitching/fixing scheme, as such details will depend on a number of factors including the target weight range, the given application, the desired comfort level and/or ease of use, applicable standards, and established safety and manufacturing know-how.

As previously discussed, the leg straps 30 and 32 may be of a fixed length or circumference so as to not shorten around the wearer's leg when a load is applied to the harness. In a no-load position, the leg straps may rest lower on the wearer's leg (i.e., when there is no load on the harness). In a load position (i.e., when a load is applied), the leg straps 30 and 32 may be pulled upward and may provide support as they slide up to a thicker portion of the wearer's thigh and/or as the weight of the wearer causes the front of the leg straps to move upwardly while the rear portion of the leg straps 30 and 32 maintains a lower position. This extension of the front portion in relation to the rear portion may result in an optimal or otherwise relatively comfortable placement of the leg strap about the thigh without actually changing the length of the leg strap. The no-load position of the leg straps 30 and 32 may be lower on the thigh than the load position and the wearer may not feel the presence of the leg straps when the harness is in a no-load position. In the embodiments shown in FIGS. 1A-3, the continuous support strap 44 is fixedly secured to leg straps 30 and 32, each of which has a fixed circumference.

As shown in FIG. 7, the leg straps 30 and 32 may be generally retained in position by one or more tabs 82. Such tabs may be used to retain each leg strap and/or support strap in position on an inside surface of the trousers 60. The straps may be removably and/or slidably retained by the tabs 82 so that they are held in position, regardless of whether the harness 10 is loaded or unloaded. The tabs 82 may include a connector such as a hook and loop fastener or a snap arrangement. This can provide, for example, a system in which the harness 10 can be retained in a comfortable position within the trousers 60, and yet can be removed from the trousers 60 when desired.

Continuous support strap 44 may form one or more support loops through which the waist belt 20 travels. In the example embodiment shown, for example, support loops 42 and 43 are provided such that continuous support strap 44 can be slideably retained by waist belt 20 (or said differently, so that waist belt 20 can be slideably retained by the continuous support strap 44). Waist belt 20 may pass through support loops 42 and 43, as shown for example in FIGS. 1A-3. Support loops 42 and 43 enable the continuous support strap 44 to move from a rest position (typically down) to a working position (typically up). The rest position is typically when there is no load on the continuous support strap 44 and the top edge of the waist belt 20 is substantially near, or in contact with, the upper edges 49 of support loops 42 and 43. The working position is typically when there is a load on the continuous support strap 44 (i.e., harness is in use), and the bottom edge of the waist belt 20 is substantially near, or in contact with, the lower edges 48 of the support loops 42 and 43. Although some of the load may be distributed to the waist belt 20, most of the load may be born by the leg straps 30 and 32. The distance between the rest position and the working position is essentially the distance between the lower edge 48, and the upper edge 49 of the continuous support strap 44 minus the width of waist belt 20. This distance is herein defined as the "stroke length" of the continuous support strap 44, and in some embodiments may range, for example, from several centimeters to more than 20 cm. In addition, the continuous support strap 44 and waist belt 20 may be constructed and arranged so that the continuous support strap 44 can slide laterally along the entire length of the waist belt 20, or just a portion of the waist belt 20 (e.g., such as less than half the length of waist belt 20, or less than one quarter the length of waist belt 20).

Figure 4:
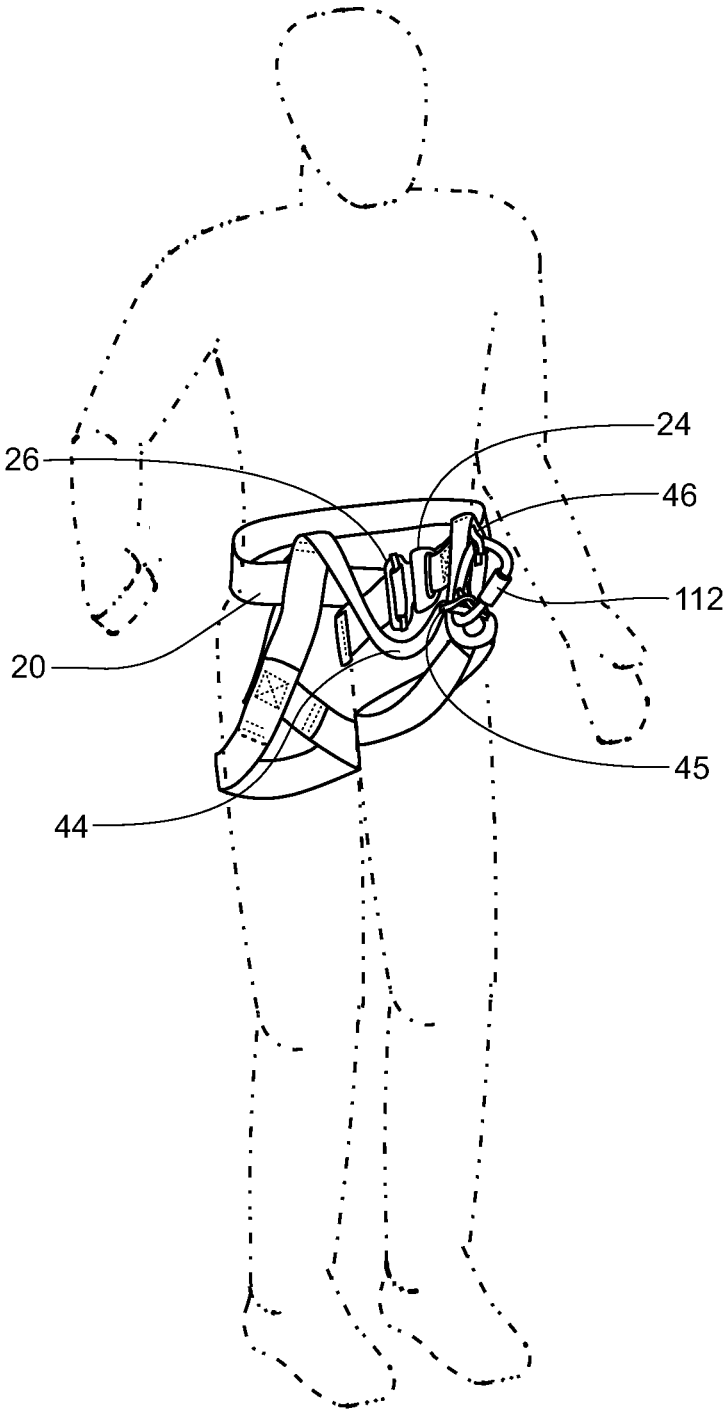
FIG. 4 shows the harness of FIG. 1A under a no-load and stowed condition, in accordance with an embodiment of the present invention.
Figure 5:
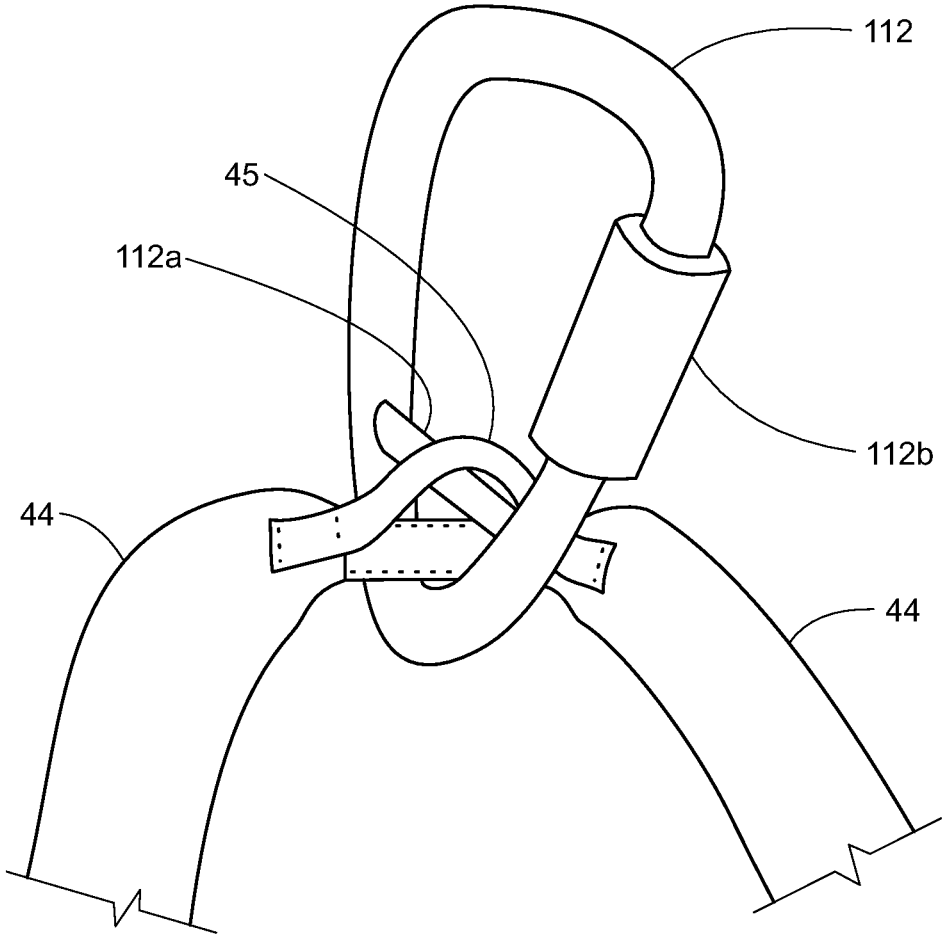
FIG. 5 shows details of how a front middle portion of a continuous support strap and keeper loop of the harness of FIG. 1A is operatively coupled to a carabiner, in accordance with an embodiment of the present invention.

As best shown in FIGS. 1A and 5, the front middle portion of the continuous support strap 44 includes an optional keeper loop 45. As best shown in FIG. 5, this keeper loop 45 works in conjunction with an optional keeper pin 112*a* of a ladder hook or carabiner 112 (or other suitable mechanism) that is securely engaged on the continuous support strap 44. The carabiner 112 can then be operatively coupled to, for example, a rope, cable, another carabiner, or the like, so that the wearer of the harness 10 can be lifted, lowered, and/or otherwise securely transported by virtue of the connection to the donned harness 10. In this example embodiment, carabiner 112 includes a spring loaded locking mechanism 112*b* that can be opened thereby allowing the carabiner 112 to be operatively coupled to, for example, ropes, cables, and the continuous support strap 44. Numerous such connector mechanisms can be used. Note that other carabiners may not have a keeper pin 112*a* and/or a locking mechanism 112*b*. In some such cases, keeper loop 45 would be unnecessary. As can be further seen with reference to FIGS. 1A and 4, the front middle portion of the continuous support strap 44 provides sufficient slack so that when not in use, the carabiner 112 can be stowed off to one side, for example, by attaching the carabiner 112 to stowing loop 46 or other suitable stowing mechanism, which may be accessible, for instance, on the exterior of the trousers 60 at the wearer's beltline. With specific reference to the example embodiment shown in FIG. 4, note that when the carabiner 112 is stowed off to the side using loop 46, the wearer still has unencumbered access to the buckle halves 24 and 26. Thus, the wearer can undo the buckle 22, for instance, without having to first unattach the carabiner 112 from fabric loop 46. Likewise, the wearer can don the trousers 60 and connect the buckle halves 24 and 26 without having to first unattach the carabiner 112 from fabric loop 46. In this sense, some embodiments of the present invention are capable of minimizing the number of steps required to don or remove the trousers 60, which is particularly beneficial for emergency responders.

In some embodiments, such as those shown in FIGS. 2 and 8, the front middle portion of the continuous support strap 44 hangs below the buckle 22 when unloaded and not stowed. In some such embodiments, the distance between buckle 22 and the unloaded and unstowed/hanging support strap 44 can range, for example, from about 1 to 12 inches, depending on how much slack is provided in the front middle portion of the continuous support strap 44. In other embodiments such as that shown in FIG. 4, and as previously explained, the front middle portion of the continuous support strap 44 has sufficient slack to hang below the buckle 22 when unloaded and stowed off to one side. In such alternative embodiments, the distance between buckle 22 and the hanging unloaded and stowed support strap 44 can range, for example, from about 1 to 6 inches, depending on how much slack is provided in the front middle portion of the continuous support strap 44. In a more general sense, some embodiments are configured with sufficient slack built into the continuous support strap 44 such that, whether stowed off to one side or hanging down below the centrally located buckle 22, the buckle 22 is accessible without significant interference from strap 44 or any coupling device attached thereto. Thus, the buckle 22 can be connected or disconnected without additional steps, such as unstowing or moving of the strap 44 or its attachments. As will be apparent in light of this disclosure, the slack should not be so excessive that that strap 44 hangs too low or is otherwise too loose. The point of the slack is to keep the centrally located buckle 22 (or other such fastener) directly and readily accessible by the wearer, without requiring the wearer to perform any additional steps to access the buckle 22.

The continuous support strap 44 and leg straps 30 and 32 can be formed from one or more straps. The number of straps used depends on factors such as desired comfort, strength rating, and applicable standards. In general, two or more straps provide greater comfort, as the harness can be more specifically shaped for comfort, whereas a single contiguous strap configuration will function for its intended purpose as described herein but may have more twist spots that may give rise to discomfort, due to the nature of a single contiguous strap design. In one example embodiment, and as shown in FIGS. 1A-3, the continuous support strap 44 and leg straps 30 and 32 are made from two distinct straps that are selectively overlapped and stitched to form the various illustrated features of the harness 10. In more detail, an as best shown in FIG. 1B, the first strap has its two ends labeled 34*a* and 34*b*, and forms the loop of leg strap 30. Note that end 34*b* is actually hidden from view in FIG. 1A, as it is underneath the second strap (hence, end 34*b* is drawn as dashed line). As can be seen, this first strap is folded over proximate to its end 34*a*, and the outgoing leg strap 30 passes through (or between) the folded over portions. Note that 'outgoing' here refers to the strap flowing from the loop of leg strap 30 toward waist belt 20 and underneath end 33*b* of the second strap. Stitching can be applied, for example, at point 35 to secure this strap sandwich once the second strap is in place on the top of the sandwich, as will be discussed in turn. As can further be seen with reference to FIG. 1B, the second strap has its two ends labeled 33*a* and 33*b*, and forms the loop of leg strap 32. This second strap is folded over proximate to its end 33*a*, and the outgoing leg strap 32 passes through (or between) the folded over portions. Note that 'outgoing' here refers to the strap flowing from the loop of leg strap 32 toward waist belt 20 and over end 34*b* of the first strap. Stitching can be applied, for example, at point 39 to secure this strap sandwich once the first strap is in place on the bottom of the sandwich, as previously explained. The overlapped portion of the first and second straps, which effectively runs from about end 33*b*, along continuous support strap 44, and to end 34*b*, can be selectively stitched to form a double-thickness strap. The support loops 42 and 43 can each be formed, for example, by not stitching portions of the overlapping first and second straps, so as to form the support loops 42 and 43 through which the waist belt 20 slides. Thus, in the embodiment shown in FIG. 1A, approximately, there is no stitching between points 35 and 36 for support loop 42, and between points 37 and 39 for support loop 43.

In other embodiments, the support strap 44 and leg straps 30 and 32 are made from a single contiguous or main strap. In one such case, one end of the single main strap is fixedly secured to or folded over a more central portion of the strap to form the leg strap 30, and the other end of the single main strap is fixedly secured to or folded over a more central portion of the strap to form the leg strap 32. In such an embodiment, the single strap only overlaps with itself at the points where the ends are stitched (e.g., generally located at points 35 and 39 of FIG. 1). In such a case, support loops 42 and 43 can each be formed, for example, by robustly stitching or otherwise fastening a relatively short piece of additional strap at both of its ends to the main single strap, so as to form the support loops through which the waist belt 20 slides. For instance, the ends of the short additional straps can be stitched at points 35 and 36 for support loop 42, and at points 37 and 39 for support loop 43. Alternatively, the single main strap can be formed into support strap 44 and leg straps 30 and 32 in a fully overlapping fashion. Selective portions of the overlapped single strap could be stitched together to effectively form a double-thickness strap. In such an alternative case, support loops 42 and 43 through which the waist belt 20 slides can each be formed by not stitching portions of the overlapped single strap (e.g., approximately, no stitching between points 35 and 36 for support loop 42, and between points 37 and 39 for support loop 43).

Other single and multi-strap configurations will be apparent in light of this disclosure, and the present invention is not intended to be limited to any particular such configuration or set of configurations. In addition, some embodiments of the floating harness 10 may include additional straps, such as rear or seat straps. For instance, some embodiments may include rear straps or seat straps that couple the leg loops 30 and 32 to the rear portion of the waist belt 20. In some embodiments, the harness 10 may consist essentially of three straps—a waist belt and two support/leg strap combinations (e.g., as previously discussed and shown in FIG. 1B). As will be apparent in light of this disclosure, the harness 10 can be self-adjusting and may require no or minimal adjustment of the waist belt 20.

The trousers 60 may be configured with one or more layers, and in the example embodiments of FIGS. 6-8 include an inner thermal layer 68 and outer layer 69. The trousers may also include features such as one or more retainers 62, guides 66, and/or openings 64 to facilitate retention of the floating harness 10 in the trousers 60 as well as external access to portions of the harness 10. Any number of suitable materials may be used in the construction of the trousers 60. Examples of such materials are described in U.S. patent application Ser. No. 11/615,262, filed on Dec. 22, 2006 and titled "Protective Apparel for Firefighters and Emergency Responders" which is herein incorporated by reference in its entirety. The trousers 60 may include a resistant barrier liner or layer that can substantially prevent the intrusion of toxic chemicals, biological pathogens, and radioactive particles. Such trousers may be referred to as C/B or CBRN trousers. The trousers 60 may also include a liner to improve the comfort of the harness system as well as to assist in keeping the harness straps properly configured in the trousers 60. When trousers comprising multiple layers are used, harness 10 may be positioned outside the outer layer, inside of the inner layer, or between an inner layer and an outer layer of the trousers. For instance, leg straps 30 and 32 may be positioned outside the leg portions of the inner layer 68 or inside the outer layer 69. In any such cases, the harness 10 can be donned properly and quickly by simply stepping into trousers 60, as will be appreciated in light of this disclosure.

In one particular embodiment, the inner layer 68 of the trousers 60 may be removably coupled to the outer layer 69 with the floating harness 10 positioned between the layers. The leg portions of inner layer 68 may be passed through the leg straps 30 and 32 of the floating harness 10, the leg straps being positioned between the leg portions of the inner layer 68 and outer garment 69. Inner layer 68 may be coupled to outer garment 69 by fasteners 74, as best shown in FIG. 7. Fasteners 74 such as, for example, buttons, hook and loop, snaps, or zippers, may be used to join layers together, either temporarily or permanently. In one particular embodiment, inner layer 68 can be removably joined to waistband 72 of the trousers 60 with snaps 74, and harness 10 may be integrated between the inner layer 68 and outer garment 69. With the harness 10 between the inner layer 68 and outer garment 69, the harness 10 becomes a part of the firefighter's ensemble such that when the firefighter dons the trousers 60, the firefighter also dons the harness 10. When the harness 10 is not in use—with the leg straps loosely encircling the firefighter's leg—the firefighter may not feel the presence of the harness 10. When the harness 10 is in use (under load), the inner layer 68 may further effectively provide padding or cushioning around the leg strap 30 and 32 areas, so as to provide greater comfort to the firefighter.

Trousers 60 may include a waistband 72. The waistband 72 may include several layers of material with reinforced stitching, and may be an area of added structural strength in the trousers 60. One or more support strap guides 66 for slideably retaining the continuous support strap 44 may be provided along the waistband. In the example embodiment shown in FIG. 6, two guides 66 are provided that pass substantially vertically through the waistband 72 such that each guide 66 is constructed and arranged to slideably receive the continuous support strap 44 of the floating harness 10. With further reference to the example embodiment of FIG. 6, two openings 64 are provided in front of the trousers 60 that allow the fastening ends of the waist belt 20 as well as the front middle portion of the continuous support strap 44 (and the keeper loop 45, if included) to pass through the openings 64 so that the buckling ends of waist belt 20 and front middle portion of the continuous support strap 44 are accessible outside the trousers 60. The width of openings 64 and guides 66 may be greater than or about equal to the width of the continuous support strap 44 or waist belt 20. In one particular embodiment, the arrangement of guides 66 and openings 64 in the trousers 60 is such that when a load is applied to the harness 10, the forces are distributed evenly across the leg straps 30 and 32. As previously explained, the guides 66 and/or openings 64 may be positioned so that the fastening point is above the wearer's center of gravity (when upright), and/or close to the wearer's body, to maintain the wearer in a generally upright position during harness use, such as when the wearer is being lowered from a building. Reinforcement may be provided around the openings 64 to provide added strength and longer wear.

The floating harness 10 may be removably or permanently coupled to an inside surface of the trousers 60. Portions of the harness 10 passing through openings 64 for external access can provide one anchoring point. A second anchoring point may be provided by retainer 62 through which waist belt 20 may be slideably retained. Retainer 62 may be positioned, for example, on the inside surface of the trousers 60 outer layer 69, in the rear portion of the trousers 60, as best shown in FIG. 6. Retainer 62 may retain the waist belt 20 on the inside surface 78 of the outer layer of the trousers. The retainer 62 may be, for example, a button, flap, loop, or a slot. If the retainer 62 is a button, the waist belt 20 may have a means such as buttonhole to facilitate non-slidable retention of the waist belt 20. In the example embodiment shown in FIG. 6, the retainer 62 is a substantially vertically oriented loop attached to an inside surface 78 of the outer layer 69 of trousers 60. In one such case, the retainer 62 is configured as a securable flap, and the flap may be secured over the waist belt 20. The flap may be secured, for example, with a button, hook and loop fasteners (such as VELCRO®), or other suitable securing means.

The waist belt 20 may be integrated into the trousers 60, along with other components of the harness 10, as best shown in FIG. 6. In such a case, internal belt loops (such as retainer 62) can be provided around the waistband 72 to keep the waist belt 20 in position, and two openings proximate the front of trousers 60 (such as openings 64), so that the buckle halves 24 and 26 are accessible outside the trousers 60. Alternatively, the waist belt 20 may be fastened externally to the trousers 60, as shown in FIGS. 7 and 8. In such a case, the trousers 60 may include slit 86 allowing support the continuous support strap 44 to pass from the interior to the exterior of the trousers 60. Slit 86 may be reinforced to resist wear and may be sized to allow passage of a support strap without providing a path of entry for chemical and biological contaminants. Waist belt 20 may be held in position on the outside of the trousers by one or more permanent or detachable loops/connectors on the side and/or rear of trousers 60, such as belt retainers 84. Belt retainer 84 may position and retain the continuous support strap 44 as well as waist belt 20, as best shown in FIG. 8. The belt retainer 84 may be positioned to provide for a comfortable and/or safe positioning for the point of attachment during a rescue. Belt retainer 84 may be made of material similar or identical to that of trousers 60. Belt retainer 84 may be stitched to or otherwise affixed to the trousers 60 and may include slots 92, 94 and 96 for receiving waist belt 20 and continuous support strap 44. Waist belt 20 may pass into slot 92 and out of slot 94, while support strap 44 may pass through slot 96. Slit 86 and slot 96 may be aligned so that support strap 44 can pass through each of slit 86 and slot 96 and can be manipulated vertically without significant interference. Although not shown in FIGS. 7 and 8, continuous support strap 44 is coupled to waist belt 20, for example, as shown in FIGS. 1A-3. Thus, once the waist belt 20 has been secured around the wearer, waist belt 20 may remain substantially immobile in relation to retainer 84 while support strap 44 may slide vertically through retainer 84 (by virtue of slot 96).

In any such embodiments (e.g., integrated waist belt 20 or external waist belt 20), the harness 10 can be configured to align the waist belt 20 with the waistband 72 of the trousers 60, providing for proper positioning of the harness 10 within (or otherwise with respect to) the trousers 60. Such embodiments also provide for external adjustment of the waist belt 20, allowing the wearer to readily tighten (or loosen) the waist belt 20. This may allow the wearer to keep the harness 10 in a substantially loose and comfortable position under most circumstances (e.g., unloaded conditions), while providing for relatively easy tightening of the waist belt 20 when needed.

As previously explained, the front middle portion of the continuous support strap 44 may optionally include a centrally positioned keeper loop 45 for maintaining a central position of a carabiner, ladder hook, or other such fastening device 112 securely coupled to the front middle portion of the continuous support strap 44. Note that a cable, rope or the like could be coupled directly to the front middle portion of the continuous support strap 44 (without a carabiner, ladder hook, etc) by way of, for example, suitable knots, or a clamp that secures a loop of rope/cable around the strap 44, or a weld that secures a loop of steel cable around the strap 44. In short, any number of coupling mechanisms may be used to securely couple to the front middle portion of the continuous support strap 44, whether a carabiner, ladder hook, knot, clamp, weld, etc, or any combinations thereof. In any such cases, the continuous support strap 44 may include slack so that it hangs down below the buckle 22, whether in a stowed (e.g., FIG. 4) or unstowed position (FIG. 8). Such slack can be used to allow the carabiner/hook 112 to be stowed in a secure, unobtrusive position when the harness 10 is not being used, and without impeding access to the buckle 22. When the carabiner/hook 112 needs to be attached to a rescue line or the like, it is readily accessible.

As will be appreciated in light of this disclosure, another embodiment of the present invention relates to a method of coupling an anchoring device to continuous support strap 44. A fastener, such as a carabiner 112 or a loop of rope or cable, for example, may be fastened to the exteriorly accessible continuous support strap 44. In one such embodiment where the support strap 44 is a single continuous strap joining both leg straps, the wearer may couple the fastener to the support strap itself (as shown in FIGS. 3-5). As the wearer's weight is applied to the harness 10, the middle portion of the continuous support strap 44 may be pulled upward until the bottom seam of the support loop 42 is retained by the waist belt 20. Waist belt 20 may remain substantially stationary while the continuous support strap 44 slides through guides 64. In some embodiments, this results in the wearer's center of gravity being below the point of attachment. As previously explained, with the wearer's center of gravity below the point of attachment, the wearer's body may be maintained in a generally upright position during lowering, raising, or other harness-loading processes.

FIG. 8 provides a perspective view of another embodiment of a safety harness 10 and trousers 60 configured in accordance with an embodiment of the present invention. In this example, the harness 10 is configured as shown in FIGS. 1-3, and includes an external waist belt 20 (worn on outside of trousers 60). In addition, the exteriorly accessible continuous support strap 44 includes a D-ring 47 that is slidably attached to the exteriorly accessible portion of strap 44. This D-ring 47 can be operatively coupled, for example, with a carabiner or other such fastening mechanism that is in turn securely connected to a cable 41 of repelling gear stored in pocket 85 of trousers 60. Thus, in the event that the wearer is in a situation, for example, where repelling downward is the only form of egress from a structure, the wearer can remove the repelling gear from pocket 85 and secure the beginning of the repelling cable 41 assembly to a nearby anchor point. With the D-ring 47 securely coupled to the other end of the repelling cable 41, the wearer can now repel to safety. As the resulting load associated with repelling is transferred to the cable 41 and D-ring 47, the D-ring 47 may slide toward the middle portion of the support strap 44. Just as when a load is placed on the carabiner 112, when a load is applied to the D-ring 47, the support loops 42 and 43 of support strap 44 may slide upwardly in relation to the waist belt 20 until the lower edge 48 of each support loop 42 and 43 is retained by a lower edge of the waist belt 20. In this case, the weight of the wearer is supported by the leg straps 30 and 32 through the continuous support strap 44 to the D-ring 47 that is securely attached to cable 41. Some of the weight may also be born by the waist belt 20, as previously explained. Thus, the point of attachment is maintained close to the wearer's body, thereby helping to maintain a stable position during use.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A floating harness comprising:

a waist belt having a fastener for adjustably securing the waist belt around a wearer's waist; and a support strap comprising:

a first leg strap for encircling a wearer's first leg, wherein the first leg strap is formed by fixing a first end of the support strap to a first portion of the support strap;

a second leg strap for encircling a wearer's second leg, wherein the second leg strap is formed by fixing a second end of the support strap to a second portion of the support strap; and a front middle portion for attaching to a coupling mechanism and having slack so as to not impede access to the waist belt fastener, wherein the front middle portion is located between the first and second portions of the support strap;

wherein the support strap is slideably attached to the waist belt in a vertical direction by a fixed stroke length, the support strap further comprising a first support loop and a second support loop through which the waist belt is slideably attached along a major length of the waist belt, wherein the first and second support loops are dimensioned larger than a width of the waist belt;

wherein the support strap comprises a single strap which is selectively overlapped and stitched together to form the first leg strap, the second leg strap, the first support loop, and the second support loop, and wherein the selective overlapping and stitching provides the support strap with one or more portions having a doubled thickness.

2. A floating harness comprising:

a waist belt having a fastener for adjustably securing the waist belt around a wearer's waist; and a support strap comprising:

a first leg strap for encircling a wearer's first leg, wherein the first leg strap is formed by fixing a first end of the support strap to a first portion of the support strap;

a second leg strap for encircling a wearer's second leg, wherein the second leg strap is formed by fixing a second end of the support strap to a second portion of the support strap; and a front middle portion for attaching to a coupling mechanism and having slack so as to not impede access to the waist belt fastener, wherein the front middle portion is located between the first and second portions of the support strap;

wherein the support strap is slideably attached to the waist belt in a vertical direction by a fixed stroke length, the support strap further comprising a first support loop and a second support loop through which the waist belt is slideably attached along a major length of the waist belt, wherein the first and second support loops are dimensioned larger than a width of the waist belt;

wherein the support strap comprises two distinct straps which are selectively overlapped and stitched together to form the first leg strap, the second leg strap, the first support loop, and the second support loop, and wherein the selective overlapping and stitching provides the support strap with one or more portions having a doubled thickness.

3. The floating harness of claims 1 or 2, wherein the first and second leg straps are both of fixed circumference.

4. The floating harness of claims 1 or 2, wherein the support strap is configured for integration into trousers that have openings which allow at least the front middle portion of the support strap to be accessed outside the trousers.

5. The floating harness of claims 1 or 2, wherein when the harness is donned by a wearer, the front middle portion of the support strap can be stowed off to one side of the waist belt fastener and still not impede access to the waist belt fastener.

6. The floating harness of claims 1 or 2, wherein the waist belt fastener is a buckle that locks when the harness is under a load.

7. The floating harness of claims 1 or 2, further comprising a keeper loop for maintaining a central position of the coupling mechanism, wherein the keeper loop is attached with the support strap at the front middle portion thereof.

8. The floating harness of claims 1 or 2, further comprising the coupling mechanism, wherein the coupling mechanism includes a carabiner, ladder hook, knot, clamp, weld, or a combination thereof.

9. The floating harness of claims 1 or 2, wherein the support strap is slideably attached to the waist belt in both a vertical direction and a horizontal direction.

10. The floating harness of claims 1 or 2, wherein the support strap is configured to provide the floating harness with a stroke length of greater than 5 centimeters.

11. A firefighter's ensemble comprising:

trousers; and a floating harness including:

a waist belt having a fastener for adjustably securing the waist belt around a fireman's waist; and a support strap comprising:

a first leg strap for encircling a fireman's first leg, wherein the first leg strap is formed by fixing a first end of the support strap to a first portion of the support strap;

a second leg strap for encircling a fireman's second leg, wherein the second leg strap is formed by fixing a second end of the support strap to a second portion of the support strap; and a front middle portion for attaching to a coupling mechanism and having slack so as to not impede access to the waist belt fastener, wherein the front middle portion is located between the first and second portions of the support strap;

wherein the support strap is slideably attached to the waist belt in a vertical direction by a fixed stroke length, the support strap further comprising a first support loop and a second support loop through which the waist belt is slideably attached along a major length of the waist belt, wherein the first and second support loops are dimensioned larger than a width of the waist belt;

wherein the support strap comprises a single strap which is selectively overlapped and stitched together to form the first leg strap, the second leg strap, the first support loop, and the second support loop, and wherein the selective overlapping and stitching provides the support strap with one or more portions having a doubled thickness.

12. A firefighter's ensemble comprising:

trousers; and a floating harness including:

a waist belt having a fastener for adjustably securing the waist belt around a fireman's waist; and a support strap comprising:

a first leg strap for encircling a fireman's first leg, wherein the first leg strap is formed by fixing a first end of the support strap to a first portion of the support strap;

a second leg strap for encircling a fireman's second leg, wherein the second leg strap is formed by fixing a second end of the support strap to a second portion of the support strap; and a front middle portion for attaching to a coupling mechanism and having slack so as to not impede access to the waist belt fastener, wherein the front middle portion is located between the first and second portions of the support strap;

wherein the support strap is slideably attached to the waist belt in a vertical direction by a fixed stroke length, the support strap further comprising a first support loop and a second support loop through which the waist belt is slideably attached along a major length of the waist belt, wherein the first and second support loops are dimensioned larger than a width of the waist belt;

wherein the support strap comprises two distinct straps which are selectively overlapped and stitched together to form the first leg strap, the second leg strap, the first support loop, and the second support loop, and wherein the selective overlapping and stitching provides the support strap with one or more portions having a doubled thickness.

13. The firefighter's ensemble of claims 11 or 12, wherein the first and second leg straps are both of fixed circumference, and the support strap is configured with support loops through which the waist belt is slideably attached.

14. The firefighter's ensemble of claims 11 or 12, wherein the first leg support strap is integrated into the trousers, the trousers having openings which allow at least the front middle portion of the support strap to be accessed outside the trousers.

15. The firefighter's ensemble of claim 14 wherein the waist belt is integrated into the trousers, the trousers having openings which allow at least the waist belt fastener to be accessed outside the trousers.

16. The firefighter's ensemble of claim 14, wherein the waist belt is coupled to outside of the trousers, the trousers having openings which allow the integrated support strap to be slideably attached to an external portion of the waist belt.

17. The firefighter's ensemble of claims 11 or 12, wherein when the harness is donned by a firefighter, the front middle portion of the support strap can be stowed off to one side of the waist belt fastener and still not impede access to the waist belt fastener.

18. The firefighter's ensemble of claims 11 or 12 further comprising a keeper loop for maintaining a central position of the coupling mechanism, wherein the keeper loop is attached with the support strap at the front middle portion thereof.

19. A firefighter's ensemble comprising:

trousers; and a floating harness including:

a waist belt having a fastener for adjustably securing the waist belt around a fireman's waist; and a support strap comprising:

a first leg strap of fixed circumference for encircling a fireman's first leg, wherein the first leg strap is formed by fixing a first end of the support strap to a first portion of the support strap;

a second leg strap of fixed circumference for encircling a fireman's second leg, wherein the second leg strap is formed by fixing a second end of the support strap to a second portion of the support strap; and a front middle portion for attaching to a coupling mechanism and having slack so as to not impede access to the waist belt fastener, wherein the front middle portion is located between the first and second portions of the support strap;

wherein the support strap is slideably attached to the waist belt by support loops slideably attached to the waist belt in a vertical direction by a fixed stroke length; and wherein the support strap is integrated into the trousers, the trousers having openings which allow at least the front middle portion of the support strap to be accessed outside the trousers, the support strap further comprising the support loops having a first support loop and a second support loop through which the waist belt is slideably attached along a major length of the waist belt, wherein the first and second support loops are dimensioned larger than a width of the waist belt;

wherein the support strap comprises a single strap which is selectively overlapped and stitched together to form the first leg strap, the second leg strap, the first support loop, and the second support loop, and wherein the selective overlapping and stitching provides the support strap with one or more portions having a doubled thickness.

20. A firefighter's ensemble comprising:

trousers; and a floating harness including:

a waist belt having a fastener for adjustably securing the waist belt around a fireman's waist; and a support strap comprising:

a first leg strap of fixed circumference for encircling a fireman's first leg, wherein the first leg strap is formed by fixing a first end of the support strap to a first portion of the support strap;

a second leg strap of fixed circumference for encircling a fireman's second leg, wherein the second leg strap is formed by fixing a second end of the support strap to a second portion of the support strap; and a front middle portion for attaching to a coupling mechanism and having slack so as to not impede access to the waist belt fastener, wherein the front middle portion is located between the first and second portions of the support strap;

wherein the support strap is slideably attached to the waist belt by support loops slideably attached to the waist belt in a vertical direction by a fixed stroke length; and wherein the support strap is integrated into the trousers, the trousers having openings which allow at least the front middle portion of the support strap to be accessed outside the trousers;

the support strap further comprising a first support loop and a second support loop through which the waist belt is slideably attached along a major length of the waist belt, wherein the first and second support loops are dimensioned larger than a width of the waist belt;

wherein the support strap comprises two distinct straps which are selectively overlapped and stitched together to form the first leg strap, the second leg strap, the first support loop, and the second support loop, and wherein the selective overlapping and stitching provides the support strap with one or more portions having a doubled thickness.

21. The firefighter's ensemble of claims 19 or 20, wherein the waist belt is integrated into the trousers, the trousers having said openings which allow at least the waist belt fastener to be accessed outside the trousers.

22. The firefighter's ensemble of claims 19 or 20, wherein the waist belt is coupled to outside of the trousers, the trousers having said openings which allow the integrated support strap to be slideably attached to an external portion of the waist belt.

23. The firefighter's ensemble of claims 19 or 20, wherein when the harness is donned by a firefighter, the front middle portion of the support strap can be stowed off to one side of the waist belt fastener and still not impede access to the waist belt fastener.

24. The firefighter's ensemble of claims 19 or 20, wherein the front middle portion of the support strap includes at least one of:

a keeper loop for maintaining a central position of the coupling mechanism, the keeper loop attached with the support strap at the front middle portion thereof; and a slideably attached D-ring.

* * * * *